US009033451B2

(12) United States Patent
Yamamoto

(10) Patent No.: US 9,033,451 B2
(45) Date of Patent: May 19, 2015

(54) PRINTED MATTER, PRINTING APPARATUS, AND PRINTING PRECISION MEASURING METHOD

(71) Applicant: Dainippon Screen Mfg. Co., Ltd., Kyoto (JP)

(72) Inventor: Takaharu Yamamoto, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 0 days.

(21) Appl. No.: 14/142,020

(22) Filed: Dec. 27, 2013

(65) Prior Publication Data

US 2014/0253625 A1 Sep. 11, 2014

(30) Foreign Application Priority Data

Mar. 6, 2013 (JP) ..... 2013-43879

(51) Int. Cl.

| | |
|---|---|
| ***B41J 29/393*** | (2006.01) |
| ***B41J 29/38*** | (2006.01) |
| ***B41J 3/60*** | (2006.01) |
| ***B42D 15/00*** | (2006.01) |

(52) U.S. Cl.
CPC *B41J 29/393* (2013.01); *B41J 3/60* (2013.01); *B42D 15/0006* (2013.01); *B42D 15/008* (2013.01)

(58) Field of Classification Search
CPC ..... B41J 29/393; B41J 11/008
USPC ..... 347/14, 19
See application file for complete search history.

(56) References Cited

U.S. PATENT DOCUMENTS

2012/0154478 A1 6/2012 Maeda ..... 347/19

FOREIGN PATENT DOCUMENTS

| | | |
|---|---|---|
| EP | 1 688 265 | 8/2006 |
| JP | 2005-212460 | 8/2005 |
| JP | 2006-327072 | 12/2006 |
| JP | 2008-272994 | 11/2008 |
| JP | 2009-154542 | 7/2009 |

OTHER PUBLICATIONS

Extended European Search Report dated May 26, 2014 for corresponding European Patent Application No. 13196837.2.

*Primary Examiner* — Jannelle M Lebron
(74) *Attorney, Agent, or Firm* — Ostrolenk Faber LLP

(57) ABSTRACT

Provided is a printed matter for measuring printing precision of a printing apparatus configured to perform printing to both sides of a printing medium. The printed matter includes a plurality of positioning reference marks printed orthogonal to a transportation direction of the printing medium; and an inspecting window bored in a positioning reference mark of the plurality of positioning reference marks, the positioning reference mark corresponding to an object to be inspected. The printing medium is folded so as to make another positioning reference mark on the printing medium visible through the inspecting window, and the positioning reference mark on a side of the inspecting window is compared with the positioning reference mark visible through the inspecting window, whereby printing precision is measured.

15 Claims, 16 Drawing Sheets

PRINTED MATTER, PRINTING APPARATUS, AND PRINTING PRECISION MEASURING METHOD

BACKGROUND OF THE INVENTION (1) Field of the Invention

The present invention relates to a printed matter, a printing apparatus, and a printing precision measuring method, the printed matter being printed with the printing apparatus such as an inkjet printing apparatus.

(2) Description of the Related Art

The apparatus of this type conventionally includes a first apply section, a first detection signal generating section, a second apply section, a second detection signal generating section, and a determining section. See, for example, Japanese Patent Publication No. 2006-327072A.

The both-side printing apparatus includes the first apply section configured to apply information on first detection signal generation to a front surface of a printing sheet. The information allows identifying a page. The first detection signal generating section reads out the information on first detection signal generation to generate a first detection signal. The second apply section applies information on second detection signal generation to a rear face of the printing sheet. The information allows identifying a page. The second detection signal generating section reads out the information on second detection signal generation to generate a second detection signal. The determining section determines a condition of both-side printing in accordance with the first and second detection signals.

With the both-side printing apparatus, the determining section determines the condition of both-side printing. This ensures to perform convenient inspection in the both-side printing.

The both-side printing apparatus mentioned above includes additional elements, such as the first detection signal generating section, the second detection signal generating section, and the determining section. These additional elements do not directly contribute to printing itself. Consequently, convenient inspection can be ensured in the both-side printing.

On the other hand, an apparatus having no additional element as above for inspection such as an inkjet printing apparatus of line scan head type determines precision of the printed matter by a user manually as under upon delivering the printing apparatus.

With the both-side printing, a surface of the printing sheet is not visible from a rear face thereof or vice versa. Accordingly, a user firstly performs printing of register marks with the same position and dimension to the surface and the rear face of the printing sheet. Secondary, a hole is bored into the center of one of the printed register marks for pagination in the printing sheet with a pushpin, for example, from one side thereof. When the hole in the center of the register mark for pagination on one side is in the same position as that on the other side, it means that no problem occurs in printing precision. On the other hand, when the hole in the center of the register mark for pagination on one side is different in position from that on the other side, it means necessity for adjustment of printing heads. Here, the both-side printing precision translates into shearing/folding precision in a process subsequent to the printing process.

Consequently, poor precision leads to poor printing. Thus, the both-side printing precision is an important point for assuring the printed matter. In transaction printing in which different contents are printed to every sheet, both-side printing precision typically ranges from 0.2 to 0.5 mm. In printing applicable to coated paper, both-side printing precision typically ranges from 0.1 to 0.2 mm.

Besides the above method, a method exist in which a printed printing sheet is placed on a light table with an intense light source to see a register mark for pagination on the opposite side through the printing sheet, thereby determining printing precision.

However, the examples of the conventional apparatus with such constructions have the following problems.

The conventional apparatus needs to include the additional elements, causing increased cost to the apparatus. Such a problem may arise. In addition, the conventional manually-inspecting method with the pushpin also depends on positional precision of a hole bored by a user with the pushpin. Accordingly, it would be hard to use the method as a measuring method having a precondition of adjusting an apparatus. Moreover, the conventional inspecting method using the light table may cause possibility of not performing inspection depending on a thickness of the printing sheet.

SUMMARY OF THE INVENTION

The present invention has been made regarding the state of the art noted above, and its one object is to provide a printed matter, a printing apparatus, and a printing precision measuring method that allow easy measurement printing precision with relatively high accuracy with no additional element to the apparatus by giving an idea to the printed matter after printing.

In order to accomplish the above object, the present invention adopts the following construction.

One aspect of the present invention discloses a printed matter for measuring printing precision of a printing apparatus configured to perform printing to both sides of a printing medium. The printed matter includes a plurality of positioning reference marks printed orthogonal to a transportation direction of the printing medium; an inspecting window bored into a positioning reference mark of the plurality of positioning reference marks, the positioning reference mark corresponding to an object to be inspected. The printing medium is folded so as to make another positioning reference mark on the printing medium visible through the inspecting window, and the positioning reference mark on a side of the inspecting window is compared with the positioning reference mark visible through the inspecting window, thereby measuring printing precision.

With the aspect of the present invention, the printing medium is folded so as to make another positioning reference mark on the printing medium visible through the inspecting window. This allows measurement of the printing precision in comparison with the positioning reference mark on the side of the inspecting window and the positioning reference mark visible through the inspecting window. Here, a user merely bores a hole. This is unaffected by measuring precision, and therefore no variation occurs to facilitate measurement. In addition, the positioning reference marks printed on the printing medium are compared to each other directly. This enhances measuring precision. As a result, easy accurate measurement of the printing precision can be achieved with no additional element in the apparatus.

Another aspect of the present invention discloses a printing apparatus for performing printing to both sides of a printing medium. The apparatus includes a printing device configured to print a plurality of positioning reference marks orthogonal to a transportation direction of the printing medium. An inspecting window is bored in a positioning reference mark of the plurality of positioning reference marks, the positioning reference mark corresponding to an object to be inspected. The printing medium is folded so as to make another positioning reference mark on the printing medium visible through the inspecting window, and the positioning reference mark on a side of the inspecting window is compared with the positioning reference mark visible through the inspecting window, thereby measuring printing precision.

With the aspect of the present invention, the printing device prints a plurality of positioning reference marks. The printing medium is folded so as to make another positioning reference mark on the printing medium visible through the inspecting window. This allows measurement of the printing precision in comparison with the positioning reference mark on the side of the inspecting window side and the positioning reference mark visible through the inspecting window. As a result, easy measurement of the printing precision can be achieved with no additional element in the apparatus.

Another aspect of the present invention discloses a printing precision measuring method for measuring printing precision of a printing apparatus configured to perform printing to both sides of a printing medium. The method includes a printing step of printing a plurality of positioning reference marks orthogonal to a transportation direction of the printing medium; an inspecting window forming step of forming an inspecting window by boring a hole in a positioning reference mark of the plurality of positioning reference marks, the positioning reference mark corresponding to an object to be inspected; and a printing precision measuring step of measuring printing precision by folding the printing medium so as to make another positioning reference mark on the printing medium visible through the inspecting window and comparing the positioning reference mark on a side of the inspecting window with the positioning reference mark visible through the inspecting window.

With the aspect of the present invention, the plurality of positioning reference marks is printed in the printing step. The inspecting window is formed in the positioning reference mark in the inspecting window forming step, the positioning reference mark corresponding to the object to be inspected. In the printing precision determining step, the printing medium is folded so as to make another positioning reference mark on the printing medium visible through the inspecting window and the positioning reference mark on the side of the inspecting window is compared with another positioning reference mark. This allows measuring printing precision. Here, a user merely bores a hole. This is unaffected by measuring precision, and therefore no variation occurs to facilitate measurement. In addition, the positioning reference marks printed on the printing medium are compared to each other directly. This enhances measuring precision. As a result, easy measurement of the printing precision can be achieved accurately with no additional element in the apparatus.

Moreover, in the aspect of the present invention, one test sample is generated in the printing step. The inspecting window is formed as a pair of inspection windows in the inspecting window forming step by boring the hole only in the center of a pair of positioning reference marks in the one test sample, the pair of positioning reference marks being on one side away from a bend line generated upon folding the test sample parallel to the transportation direction. In the printing precision measuring step, the one test sample is folded along the bend line, and the pair of positioning reference marks on the side of the inspecting window is aligned with the pair of positioning reference marks on an opposite side across the bend line. Then, a printing length on one side of the test sample is measured from a distance between the pair of positioning reference marks visible through the pair of inspecting window. A printing length on the other side of the test sample is measured from a distance between the pair of positioning reference marks on the side of the inspecting window. A deviation of printing start positions on the one side and the other side is measured from a deviation amount of the positioning reference marks on the side of the pair of inspecting windows and the positioning reference marks visible through the pair of inspecting windows in a direction orthogonal to the transportation direction. Such above is preferable.

The one test sample is folded parallel to the transportation direction with reference to the bend line to overlap a pair of positioning reference marks on a side of the inspecting window-pair on a pair of positioning reference marks on the opposite side across the bend line. Then the printing length is measured on one side of the test sample in accordance with a distance between the pair of positioning reference marks visible through the pair of inspecting windows. Moreover, the printing length on the other side of the test sample is measured in accordance with a distance between the pair of positioning reference marks on the side of the inspecting window-pair side. In addition, the deviation of printing start positions on the one side and the other side is measured in accordance with a deviation amount of the positioning reference mark on the side of the inspecting window-pair and the positioning reference marks visible through the pair of inspecting windows in the direction orthogonal to the transportation direction Simply accordion-folding the one test sample on the bend line and measuring a dimension of each part allows measurement of the deviation of the printing start positions on the one side and the other side.

Moreover, according to the aspect of the present invention, it is preferable that a linear test pattern is printed orthogonal to the transportation direction in the printing step. Moreover, it is preferable that one end of the one test sample along the pair of inspecting windows is folded by a given width toward the pair of inspecting windows with the test sample being folded to confirm the linear test pattern at a folded portion of the test sample to the linear test pattern exposed due to folding the test sample.

The one end of the one test sample along the pair of inspecting windows is folded by a given width toward the pair of inspecting windows to confirm the linear test pattern at the folded portion of the test sample to the linear test pattern exposed due to folding the test sample. This achieves accurate folding of the test sample. Accordingly, accurate measuring can be performed to the printing lengths on the one side and the other side as well as to the deviation of printing start positions on the one side and the other side.

Moreover, according to the aspect of the present invention, two test samples are generated in the printing step. In the inspecting window forming step, only the center of each of a first positioning reference mark, a second positioning reference mark, and a third positioning reference mark each seen like a hook in plan view is bored to form an inspecting window. Here, the first and second positioning reference marks of one of the test sample are away from each other at two portions along the end in the transportation direction. The third positioning reference mark is away from the first positioning reference mark across the center in the transportation direction. In the printing precision measuring step, one of the test samples is turned by 90 degrees relative to the other test sample to locate the other test sample on a back face of the one test sample, and the first positioning reference mark conforms to the positioning reference mark of the other test sample through the inspecting window and the third positioning reference mark conforms to the positioning reference mark of the other test sample through the inspecting window, and thereafter, a deviation amount of the second positioning reference mark and the positioning reference mark of the other test sample through the inspecting window relative to a line connecting the first positioning reference mark with the second positioning reference mark is measured, whereby orthogonality in the transportation direction of the printing medium and the printing device configured to perform printing to the printing medium is measured. Such above is preferable.

Firstly, one of the test samples is turned by 90 degrees relative to the other test sample to locate the other test sample on the back face of the one test sample. Then, the first positioning reference mark conforms to the positioning reference mark of the other test sample through the inspecting window, and the third positioning reference mark conforms to the positioning reference mark of the other test sample through the inspecting window. When the printing device is not located orthogonal to the transportation direction of the printing medium, the printing device produces a printing result of a parallelogram. In this case, a base of the one test sample conforms to an oblique line of the other test sample. Thereafter, measured is a deviation amount of the second positioning reference mark and the positioning reference mark of the other test sample through the inspecting window relative to a line connecting the first positioning reference mark with the second positioning reference mark. Consequently, an angle made by the oblique lines of the parallelogram that are inclined opposite to each other is to be measured, resulting in measurement of a double deviation amount relative to orthogonality to the transport direction. As a result, orthogonality in the transportation direction of the printing medium and the printing device configured to perform printing to the printing medium can be measured.

Moreover, according to the aspect of the present invention, two test samples are generated in the printing step. In the inspecting window forming step, one test sample is cut to form a strip piece containing the plurality of positioning reference marks printed on one side of the one test sample, a notch is formed in each of the plurality of positioning reference marks on one side, the notch being foldable relative to a line along the transportation direction. The strip piece is reversed in the transportation direction such that the other side of the strip piece is directed upward, and each notch is folded to the other side, whereby the inspecting window is formed. In the printing precision measuring step, the strip piece overlaps the plurality of positioning reference marks in the other test sample. Under a state where both ends of the plurality of positioning reference marks in the strip piece are aligned with both ends of the plurality of positioning reference marks in the other test sample by the line orthogonal to the transportation direction, a deviation amount of the positioning reference marks visible through the plurality of inspecting windows other than the both ends and orthogonal to the transportation direction and the positioning reference mark on the plurality of inspecting windows and folded orthogonal to the transportation direction is measured, whereby a step in the transportation direction of the plurality of printing heads orthogonal to the transportation direction is measured. Such above is preferable.

Here, the strip piece overlaps the plurality of positioning reference marks in the other test sample strip. In addition, both ends of the plurality of positioning reference marks in the strip piece is aligned with both ends of the plurality of positioning reference marks in the other test sample by the line orthogonal to the transportation direction. Then measured is a deviation amount of the positioning reference mark (on one side) visible through the plurality of inspecting windows other than the both ends and orthogonal to the transportation direction and the positioning reference mark (on the other side) on the plurality of inspecting windows and folded in a direction orthogonal to the transportation direction. Since the other test sample is located opposite to the strip piece in the transportation direction, a double amount of deviation in orthogonality is to be measured. As a result, a step in the transportation direction of the plurality of printing heads located orthogonal to the transportation direction can be measured accurately.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Description will be given in detail of a preferred embodiment of the present invention with reference to drawings.

Figure 1:
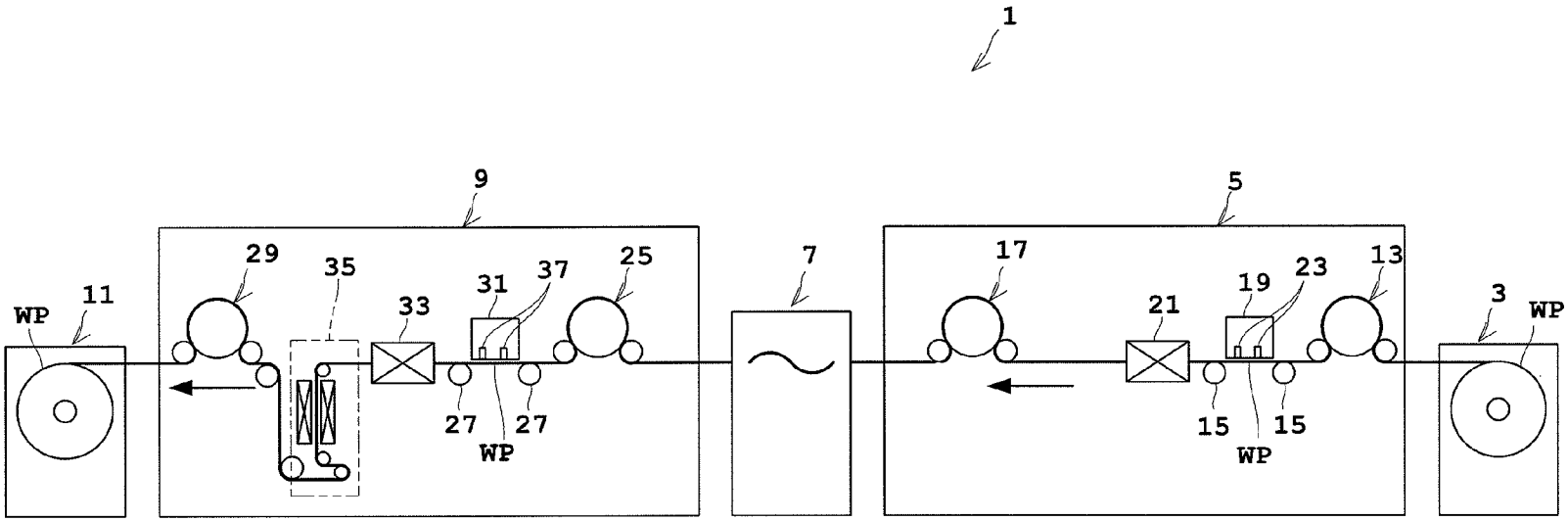
FIG. 1 is a schematic view of an inkjet printing apparatus in its entirety according to one embodiment.

FIG. 1 is a schematic view of an inkjet printing apparatus in its entirety according to one embodiment.

An inkjet printing apparatus 1 according to the embodiment includes a paper feeder 3, a surface printing unit 5, an inversion unit 7, a rear face printing unit 9, and a take-up roller 11.

The paper feeder 3 feeds web paper WP stored in a roll form. The surface printing unit 5 is, for example, of an inkjet type, and performs printing to a surface of the web paper WP. The inversion unit 7 includes a plurality of rollers. The inversion unit 7 inverts a rear face of the web paper WP to be directed upward. The rear face printing unit 9 is, for example, of an inkjet type, and performs printing to the rear face of the web paper WP. The take-up roller 11 reels the web paper WP in a roll form, the web paper WP having both printed sides.

The paper feeder 3 holds web paper WP in a roll form to be rotatable about a horizontal axis. The paper feeder 3 unreels the web paper WP to feed it to the surface printing unit 5. The take-up roller 11 unreels the web paper WP about a horizontal axis. Here, the web paper WP has both printed sides.

The surface printing unit 5 includes a drive roller 13 in an upstream position thereof. The drive unit 13 takes the web paper WP from the paper feeder 3. The web paper WP unreeled from the paper feeder 1 by the drive roller 13 is transported downstream along a plurality of transport rollers 15. The surface printing unit 5 includes a drive roller 17 on the most downstream position thereof. A printer 19 and a drying unit 21 are arranged in this order from the upstream between the drive rollers 13 and 17. The printer 19 includes inkjet heads 23. The drying unit 21 dries a portion of the web paper WP printed by the printer 19.

The inversion unit 7 inverts a side of the web paper WP fed out from the drive roller 17 of the surface printing unit 5. Then the inversion unit 7 feeds out the inverted web paper WP to the rear face printing unit 9.

The rear face printing unit 9 includes a driving roller 25 in an upstream position thereof for taking the web paper WP from the inversion unit 7. The web paper WP taken by the drive roller 25 is transported downstream along a plurality of transporting rollers 27. The rear face printing unit 9 includes a drive roller 29 in the most downstream position thereof. The rear face printing unit 9 includes a printer 31, a drying unit 33, and a both-side inspecting unit 35 in this order from the upstream between the drive rollers 25 and 29. The printer 31 includes inkjet heads 37. The drying unit 33 dries a portion of the web paper WP printed by the printer 31. The both-side inspecting unit 35 inspects both sides of the web paper WP printed by the printers 19 and 31.

A controller, not shown, of the inkjet printing apparatus 1 having the above construction receives printing data from a computer, not shown. Then the controller controls the surface printing unit 5 and the rear face printing unit 9 in accordance with the printing data to print an image based on the printing data to both sides of the web paper WP.

The printers 19 and 31 correspond to the "printing device" in the present invention.

<Measurement of Printing Start Position and Printing Length>

Figure 2:
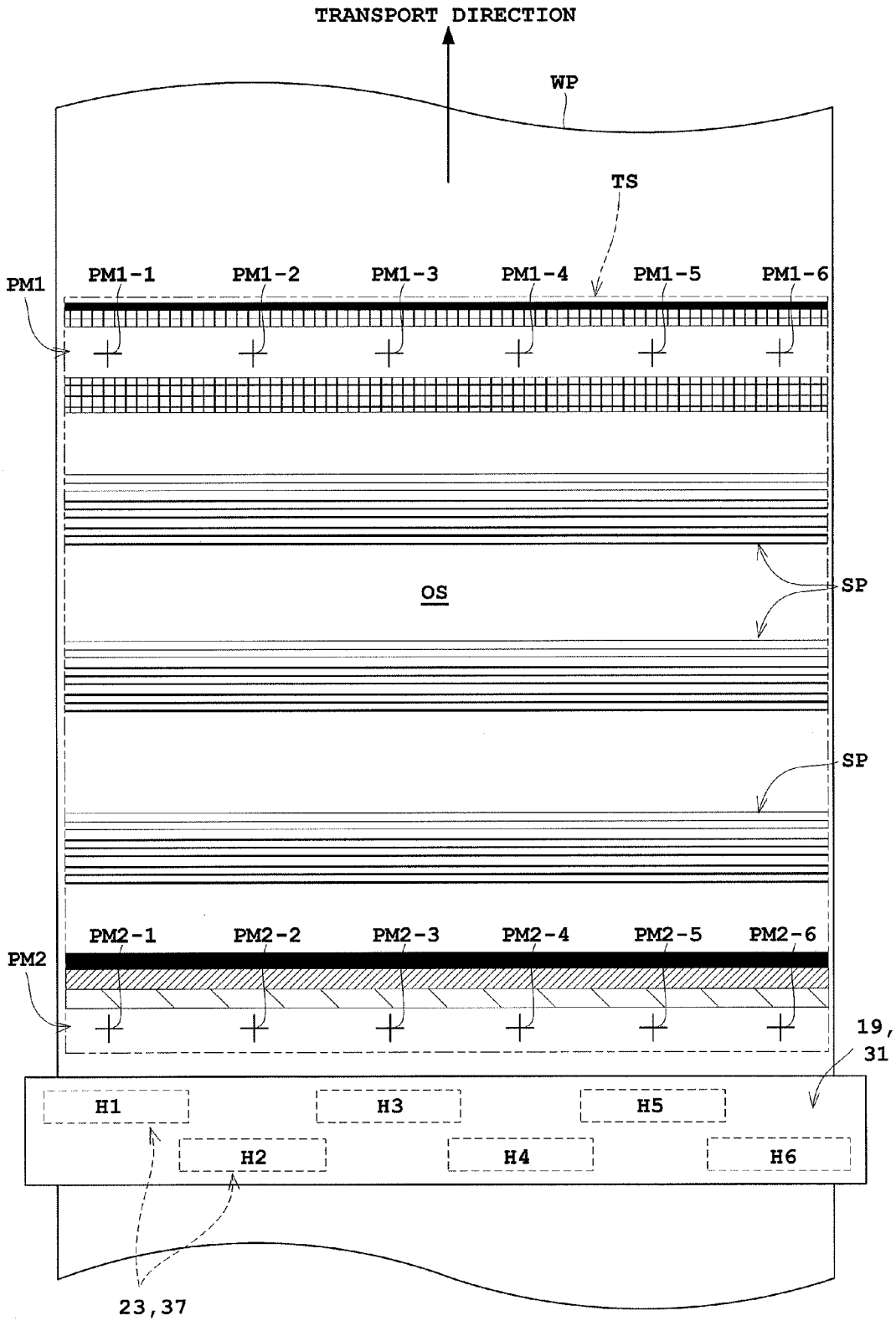
FIG. 2 is a schematic view illustrating one example of a test sample containing a positional relationship of a printing sheet and a printer as well as positioning reference marks.
Figure 5:
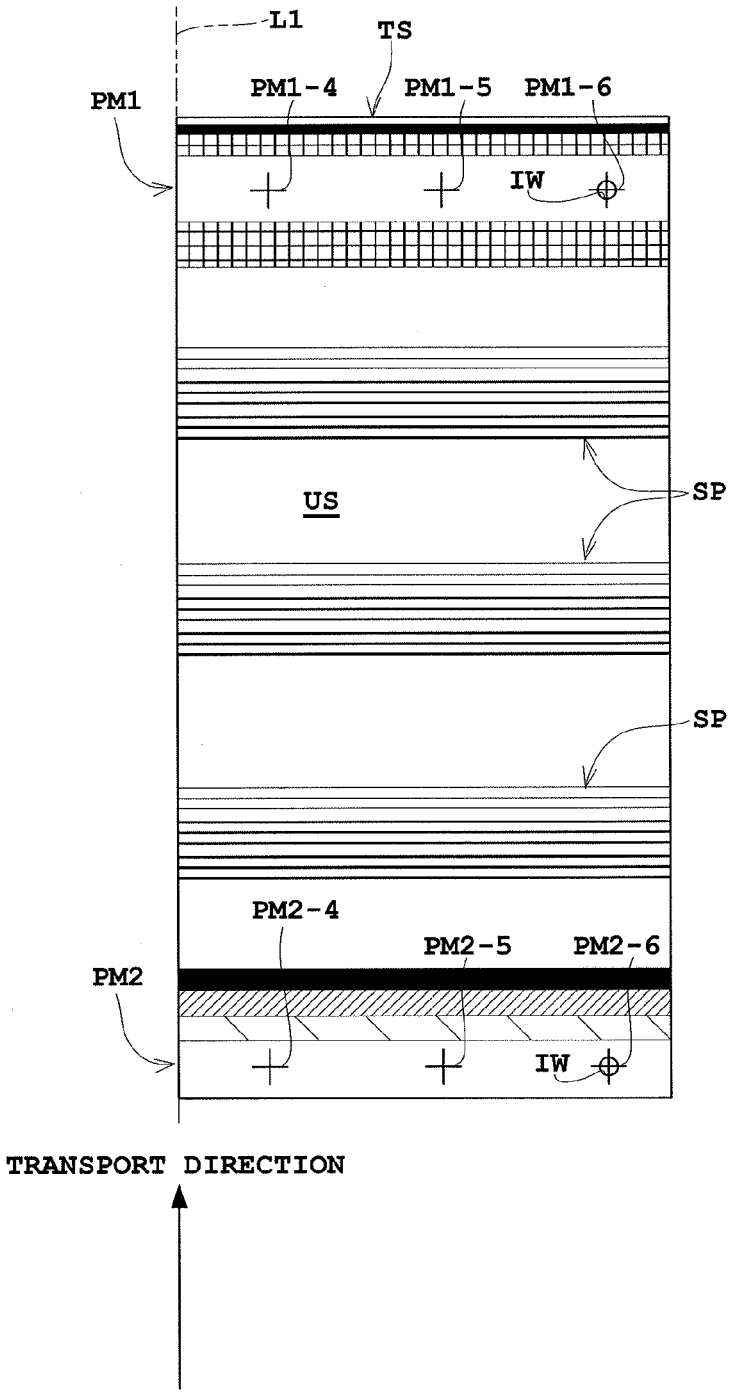
Figure 6:
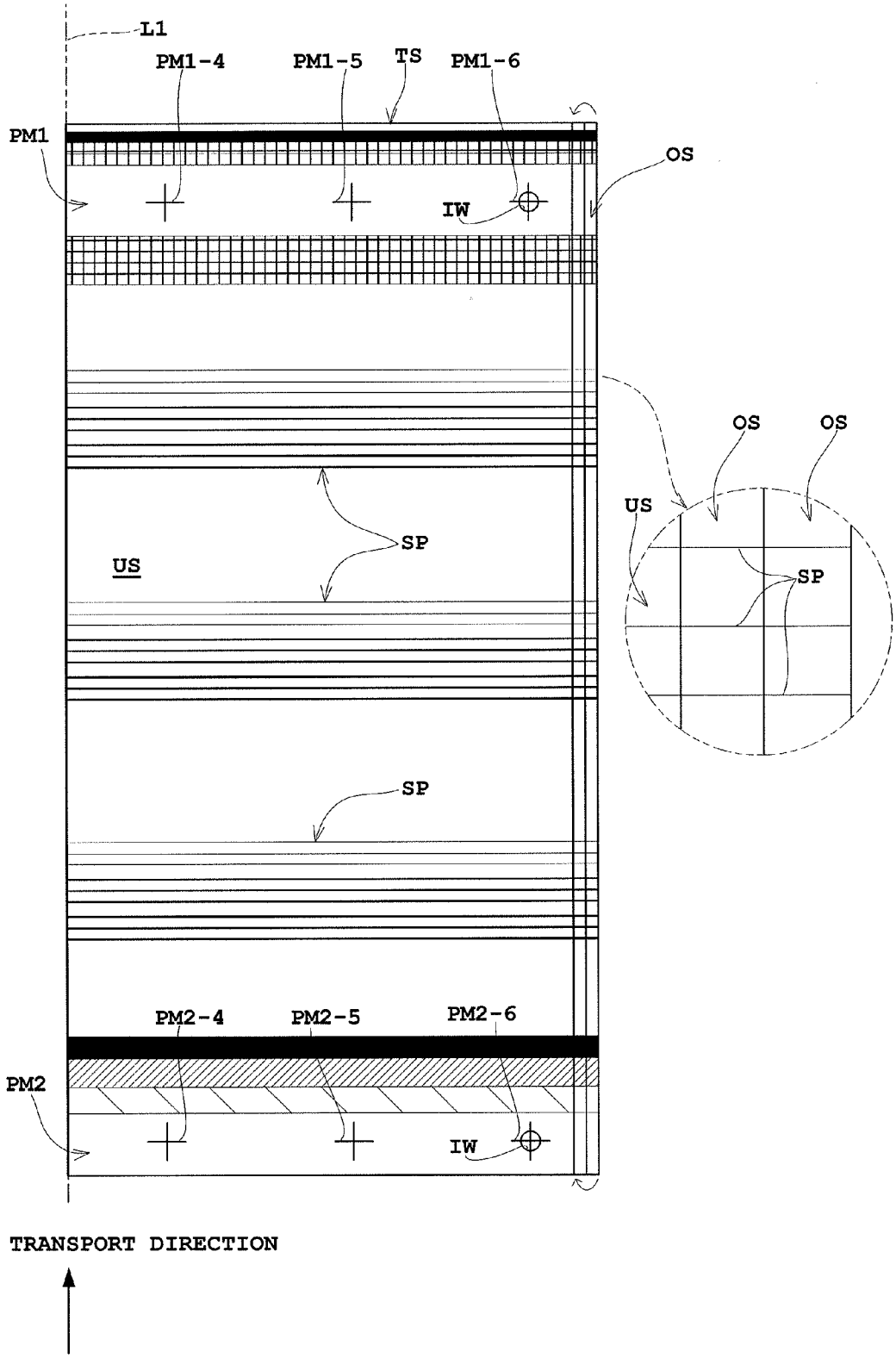
Figure 7:
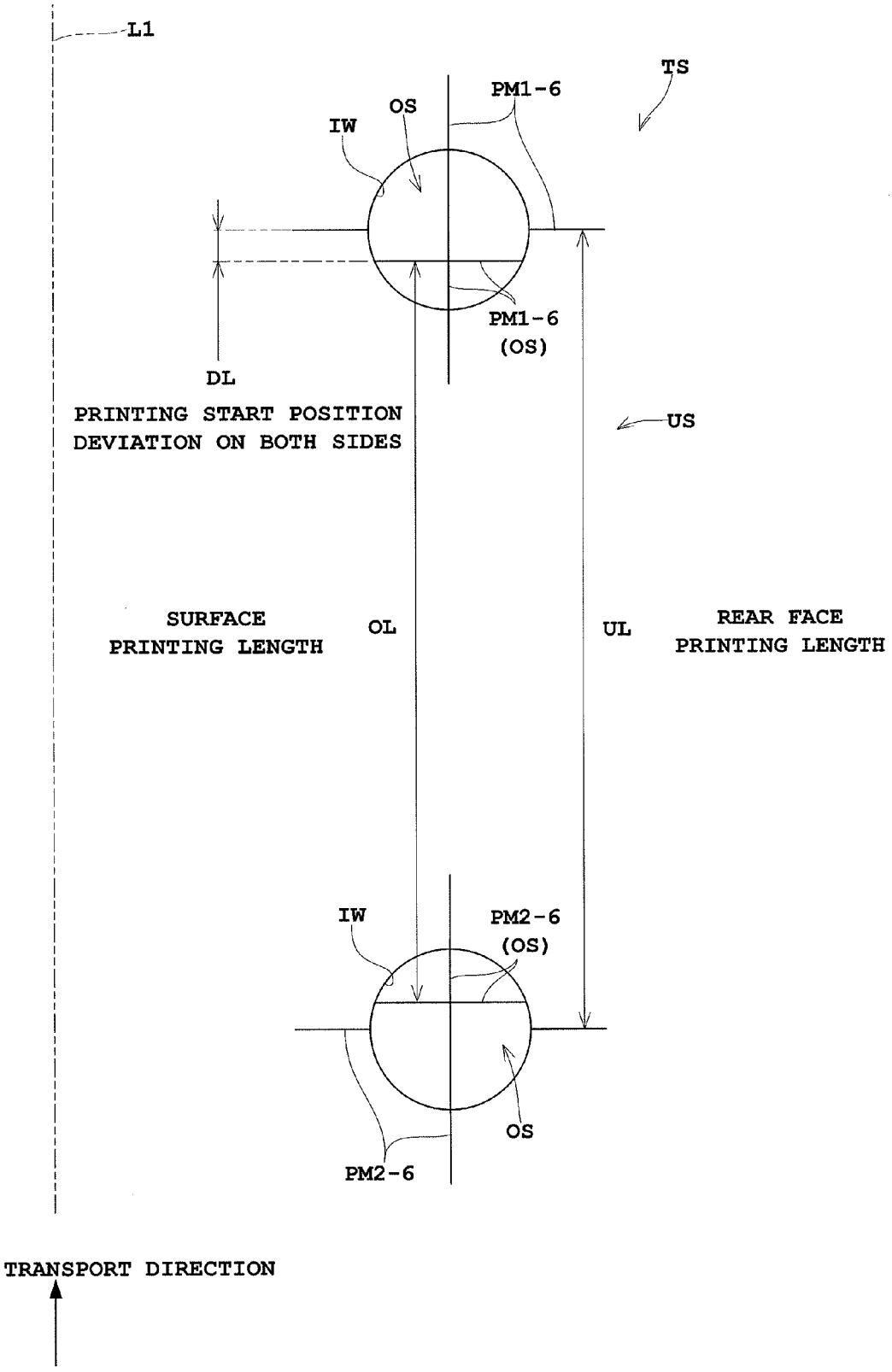
FIG. 7 is an explanatory view of measuring the printing start position and the printing length.

Now reference is made to FIGS. 2 to 7. FIG. 2 is a schematic view of a test sample containing a positional relationship between a printing sheet and a printer as well as positioning reference marks. FIGS. 3 to 6 are schematic views each illustrating generation of the test sample used for measuring a printing start position and a printing length. FIG. 7 is an explanatory view of measuring the printing start position and the printing length.

For instance, six printers 19 and 31 each contain six inkjet heads 23 and 37, respectively, in a staggered arrangement (zigzag arrangement) orthogonal to a transportation direction. Here, when each inkjet head in the inkjet heads 23 and 37 of the printers 19 and 31, respectively, need to be identified, the inkjet heads are to be denoted by H1 to H6 from the left in a direction orthogonal to the transportation direction of the web paper WP.

Upon receiving a command about test printing from an operator, an inkjet printing apparatus 1 prints a test sample TS. The test sample TS corresponds to a "printed matter" having an inspecting window to be mentioned later. This process corresponds to a "printing step" in the present invention. The test sample TS is generated having a plurality of positioning reference marks PM (PM1, PM2) and linear test patterns SP on the web paper WP orthogonal to the transportation direction. The positioning reference mark PM1 is printed on a printing start position of the test sample TS. The positioning reference mark PM2 is printed on a printing termination position of the test sample TS. In this example, the positioning reference marks PM1 and PM2 each have a cross-shaped pattern. The linear test pattern SP is printed between the positioning reference marks PM1 and PM2 linearly and orthogonally to the transportation direction. Here, every six positioning reference marks PM1 and PM2 are printed at given intervals orthogonally to the transportation direction. In the following description, the positioning reference marks PM1 are denoted by positioning reference marks PM1-1 to PM1-6 from the left as necessary. Similarly, the positioning reference marks PM2 are denoted by positioning reference marks PM2-1 to PM2-6 from the left as necessary. The test sample TS in FIG. 2 has both sides printed similarly. Accordingly, positioning reference marks PM1 and PM2 on a rear side of the test sample TS are printed in the same position as those on a front side OS of the test sample TS. The inkjet head H1 prints the positioning reference mark PM1-1. In succession, the inkjet heads H2 to H6 print the positioning reference marks PM1-2 to 1-6, respectively.

Figure 3:
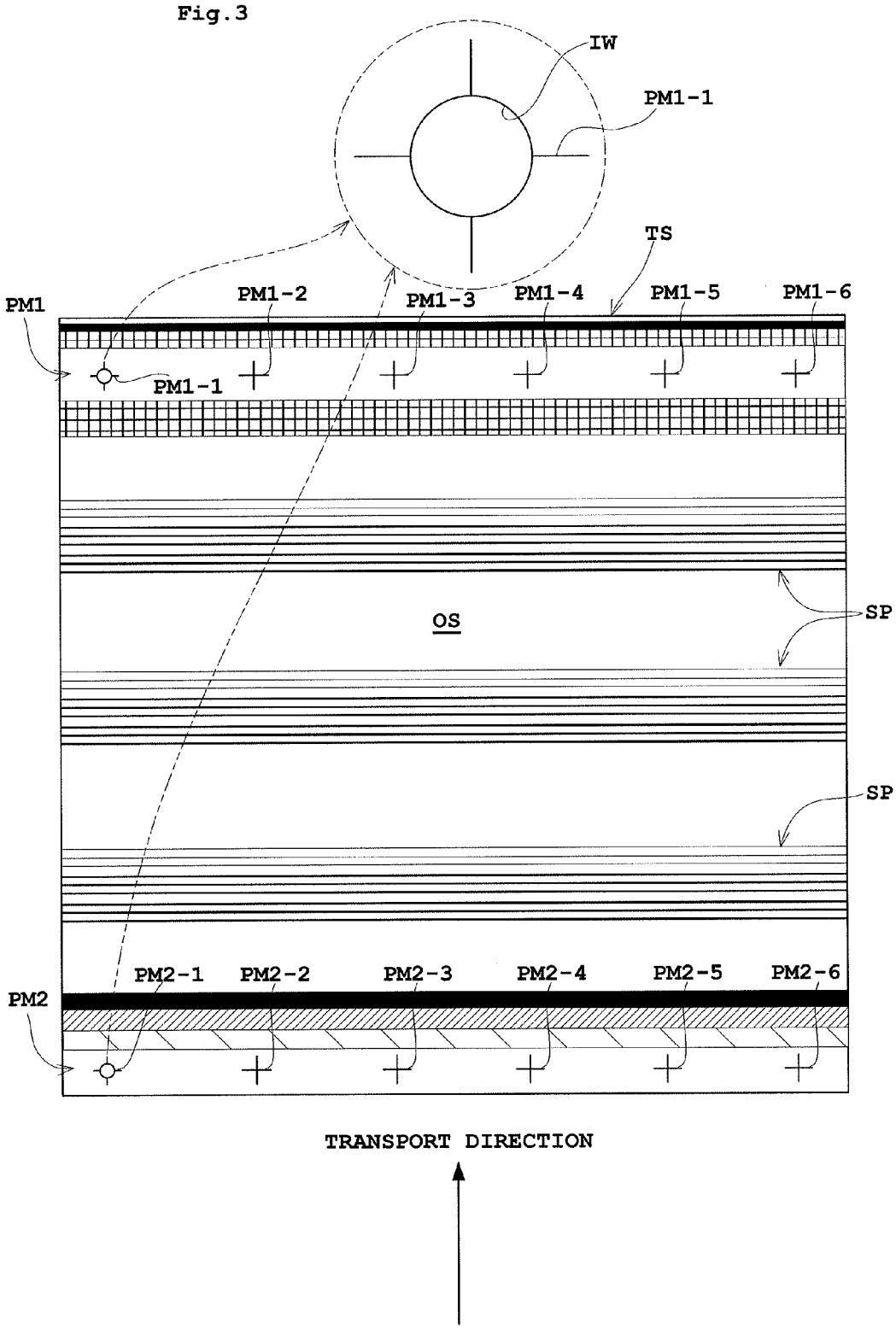
FIGS. 3 to 6 are schematic views each illustrating the test sample used for measuring a printing start position and a printing length.

The test sample TS generated as mentioned above is cut out from the web paper WP to make one test sample TS illustrated in FIG. 3. Here, the front side OS of the test sample TS is to be directed upward. Then inspecting windows IW are formed in the positioning reference marks PM1-1 and PM2-1. The positioning reference marks PM1-1 and PM2-1 are a pair of positioning reference marks on ends of the test samples TS in the transportation direction. The inspecting windows IW are each formed by boring each center of cross-shaped portions in the positioning reference marks PM1-1 and PM2-1. That is, upper and lower ends and left and right ends of the cross-shaped portions in the positioning reference marks PM1-1 and PM2-1 remain.

The above process corresponds to the "inspecting window forming step" in the present invention.

Figure 4:
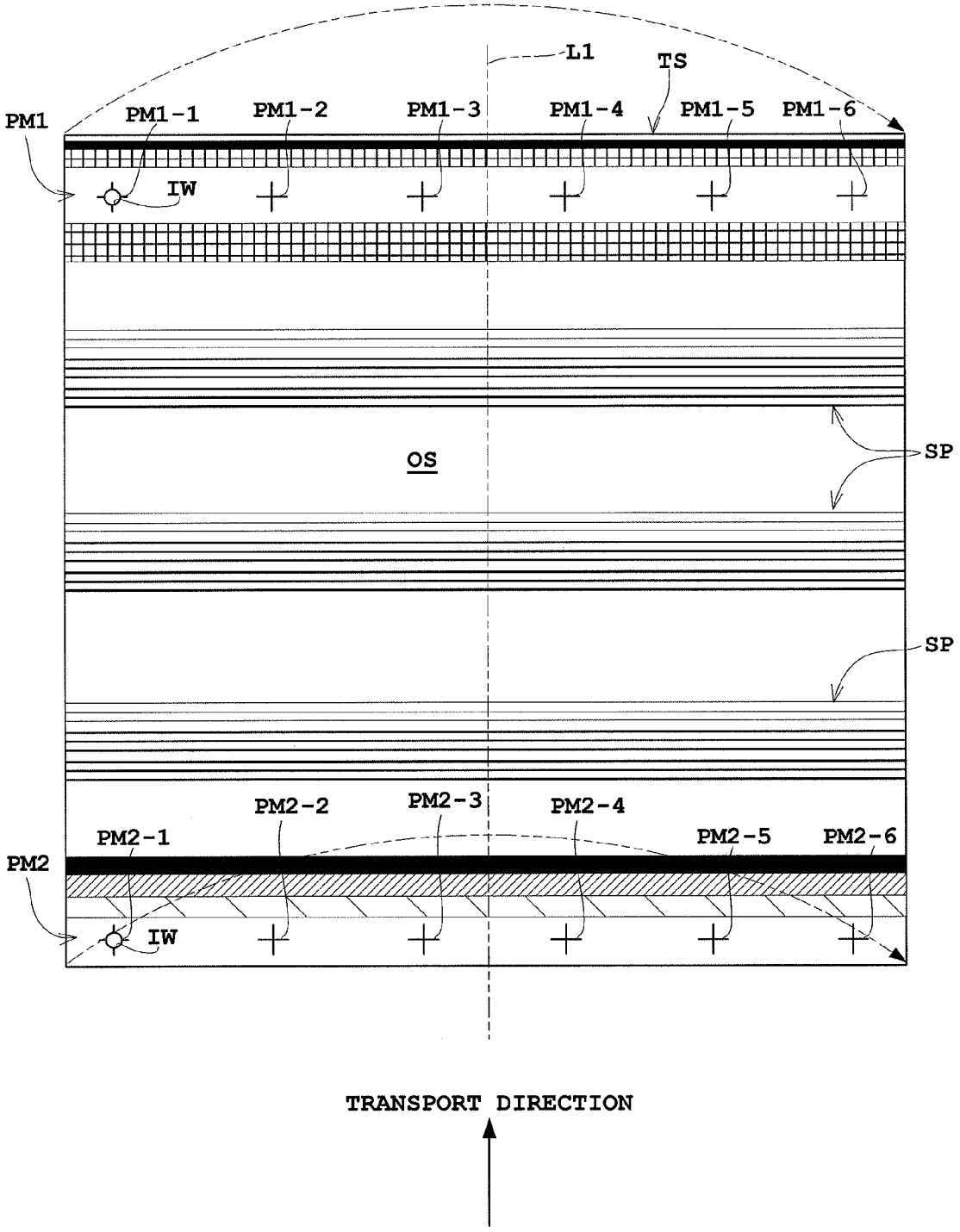

Next, as illustrated in FIGS. 4 and 5, the test sample TS is folded. Specifically, the test sample TS is accordion-folded with a bend line L1 in the transportation direction to make alignment of a positioning reference mark PM1-6 on a rear side US (a positioning reference mark PM1-1 on the front face OS) with the positioning reference mark PM1-6 on the front side OS and to make alignment of and a positioning reference mark PM2-6 on the rear side US (a positioning reference mark PM2-1 on the front side OS) with the positioning reference mark PM2-6 on the rear side US. Here, the alignment is to conform a line of the positioning reference mark PM1-6 on the rear side US in the transportation direction to a line of the positioning reference mark PM1-6 on the front side OS in the transportation direction. The positioning reference mark PM1-6 on the front side OS and the positioning reference mark PM2-6 on the front side OS are visible from the positioning reference mark PM1-6 on the rear side US and the positioning reference mark PM2-6 on the rear side US, respectively, through the inspecting windows IW. This facilitates the alignment.

Next, as illustrated in FIG. 6, a side edge of the test sample TS on a side of the inspecting window IW-pair is folded toward the pair of inspecting windows IW. This corrects folding of the test sample TS with the bend line L1 such that linear test patterns SP on the rear side US linearly conform to linear test patterns SP on the rear side US exposed due to the folding. Accordingly, folding for inspection can be performed accurately.

Where the above folding can be performed accurately with use of a jig or the like, it is no need to fold the side edge of the test sample TS to conform the test patterns SP to each other.

As illustrated in FIG. 7, each part is measured through the inspecting window IW with the test sample TS undergoing the above procedure. Accordingly, a rear face printing length UL, a surface printing length OL, and a printing start position deviation on both sides DL can be measured at one time. This process corresponds to a "printing precious measuring step" in the present invention. Specifically, the rear face printing length UL corresponds to a length between a line of the positioning reference mark PM1-6 on the rear side US orthogonal to the transportation direction and a line of the positioning reference mark PM2-6 on the rear side US orthogonal to the transportation direction. The surface printing length OL corresponds to a length between a line of the positioning reference mark PM1-6 on the front side OS orthogonal to the transportation direction and a line of the positioning reference mark PM2-6 on the rear side OS orthogonal to the transportation direction, both the positioning reference marks being visible through the inspection window IW. The printing start position deviation DL on both sides corresponds to a length between the line of the positioning reference mark PM1-6 on the rear side US orthogonal to the transportation direction and the line of the positioning reference mark PM1-6 on the front side OS orthogonal to the transportation direction and visible through the inspection window IW. These have an order of a few ten to hundred micrometers, and up to millimeters. Thus, it is preferable that these are measured while being magnified with a magnifying glass or measured with a measuring machine.

<Orthogonality Measurement>

Figure 8:
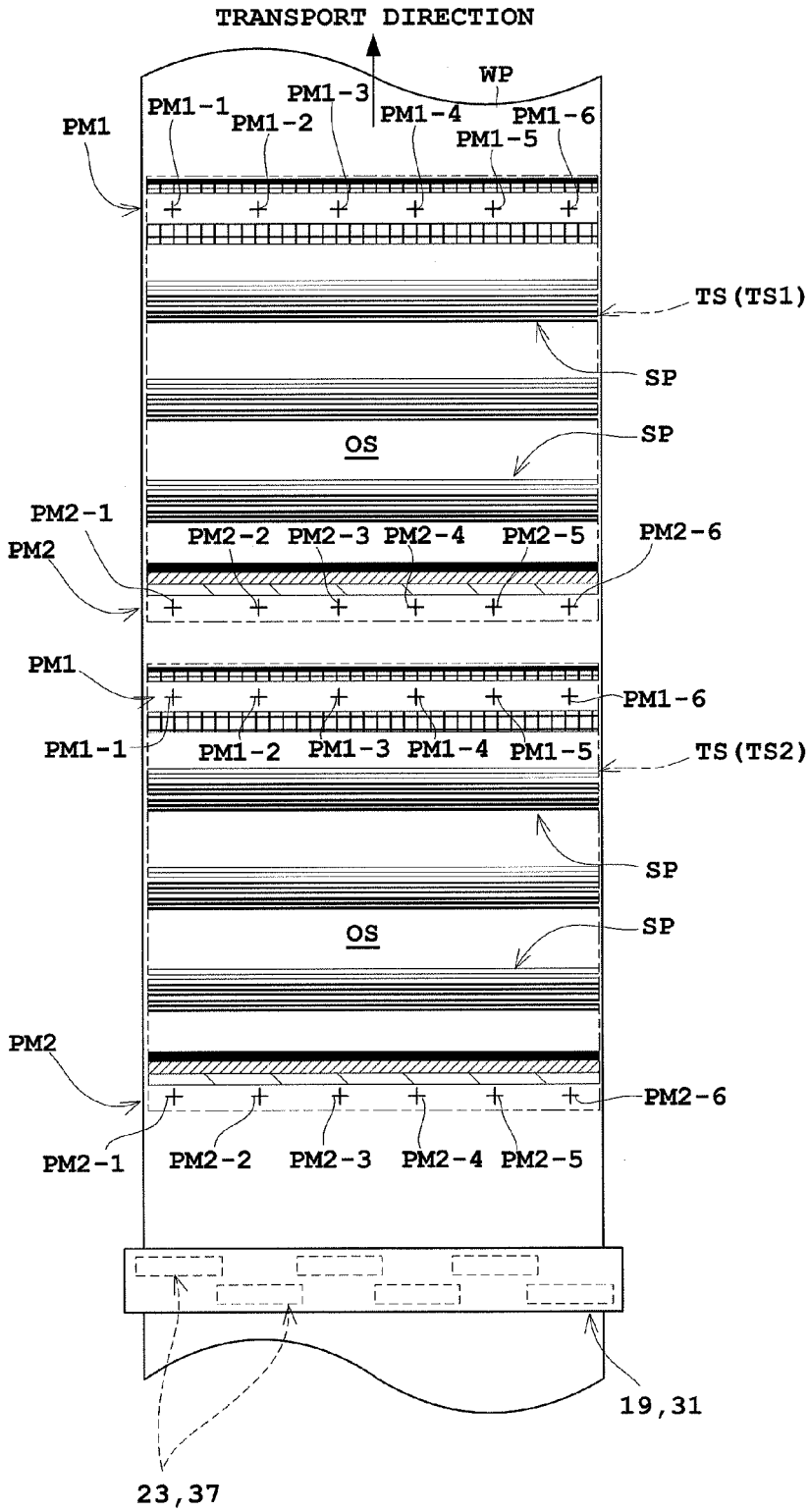
FIG. 8 illustrates one example of a test sample used for measuring a positional relationship between the printing sheet and the printer as well as orthogonality.
Figure 9:
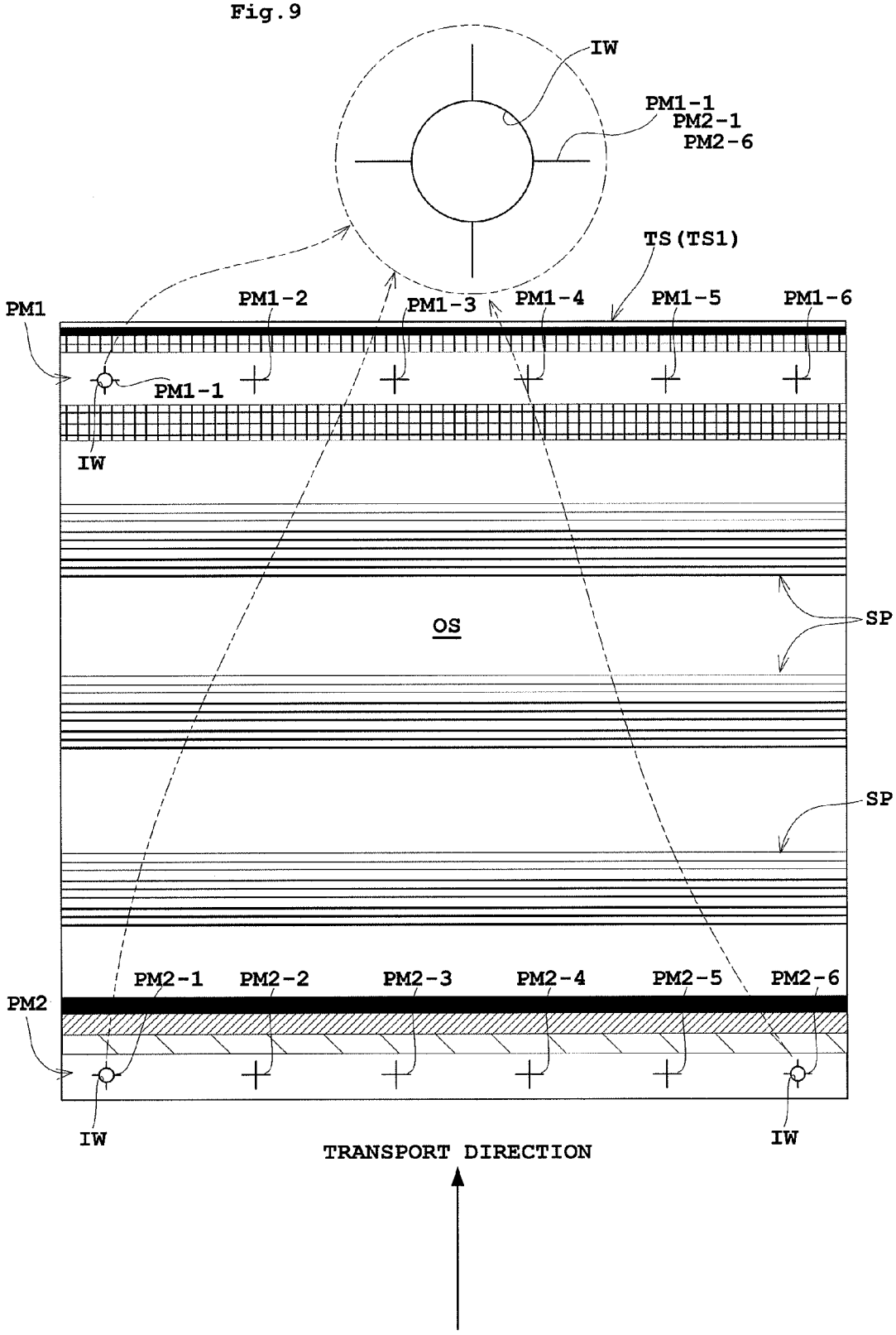
FIGS. 9 and 10 are schematic views each illustrating the test sample used for measuring orthogonality.
Figure 10:
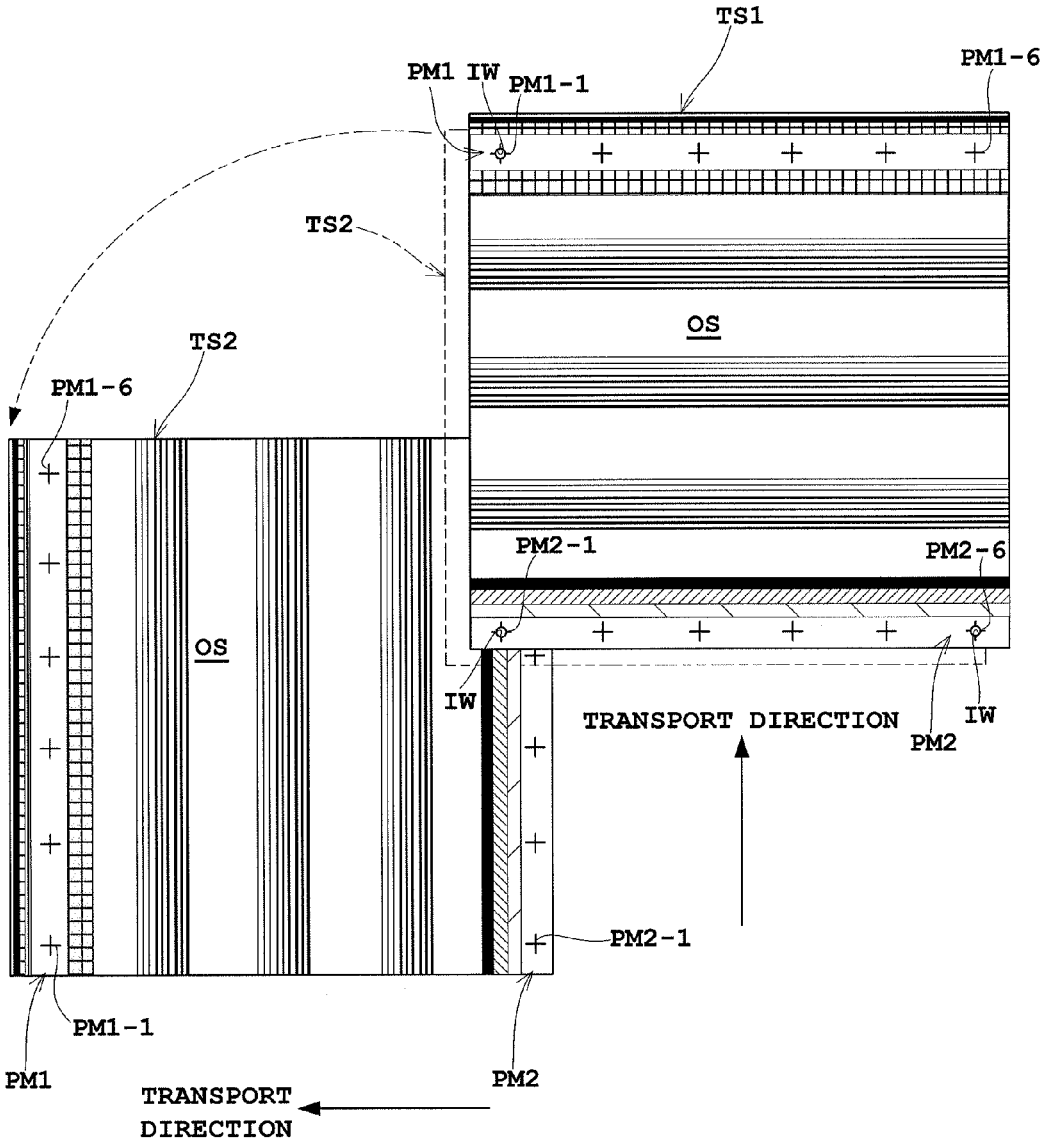
Figure 11:
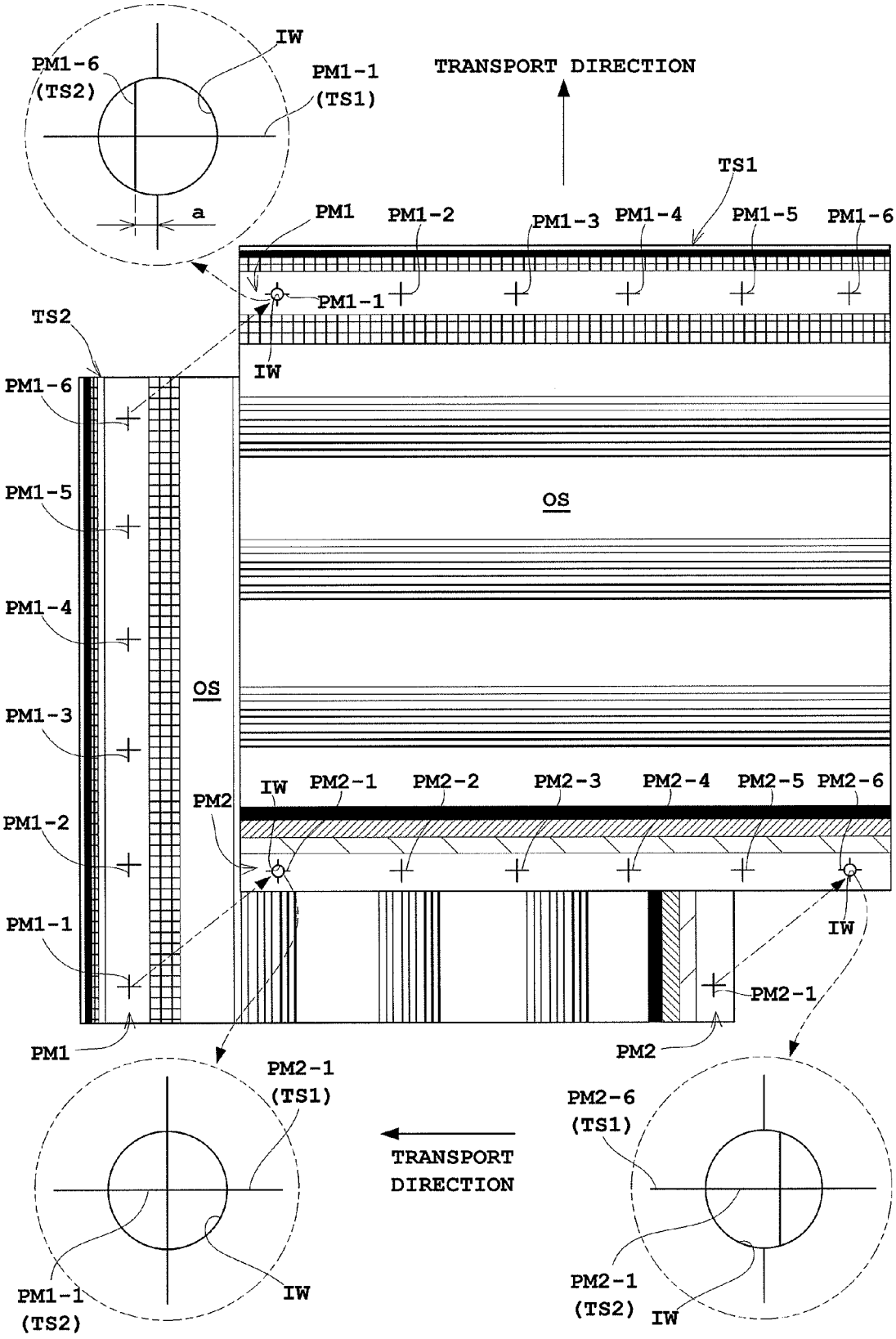
FIG. 11 is an explanatory view of measuring orthogonality.
Figure 12:
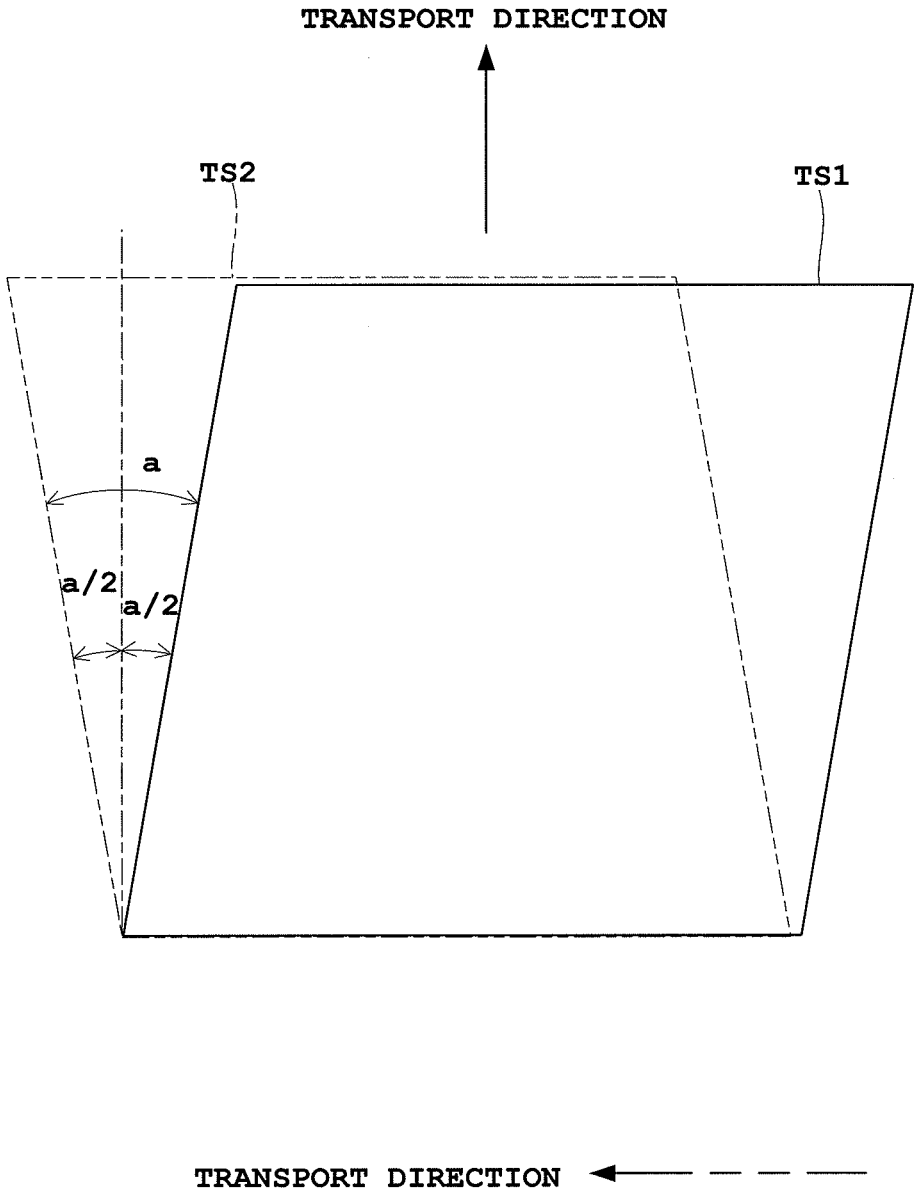
FIG. 12 is an explanatory view for a principle of measuring orthogonality.

Now reference is made to FIGS. 8 to 12. FIG. 8 illustrates one example of a test sample used for measuring a positional relationship between a printing sheet and a printer as well as orthogonality. FIGS. 9 and 10 are schematic views each illustrating formation of the test sample used for measuring orthogonality. FIG. 11 is an explanatory view of measuring orthogonality. FIG. 12 is an explanatory view of a principle of measuring orthogonality.

In order to measure orthogonality, two test sample TS mentioned above are generated as in FIG. 8. These test samples TS (TS1,TS2) each have printed positioning reference marks PM1-1 to PM1-6 and PM2-1 to PM2-6 as well as linear test patterns SP.

This process corresponds to the "printing step" in the present invention.

Firstly, as illustrated in FIG. 9, only the center of each of the positioning reference marks PM1-1, PM2-1 and PM2-6 in one test sample TS1 is bored to form the inspecting window IW. Here, the positioning reference marks PM1-1 and PM2-1 are spaced away from each other on the ends in the transportation direction. The positioning reference mark PM2-6 is spaced away from the positioning reference mark PM2-1 across the center line in the transportation direction. These positioning reference marks PM1-1, PM2-1 and PM2-6 are located in an L-shape on the ends and corners of the test sample TS1.

This process corresponds to the "inspecting-window forming step" in the present invention.

Next, as illustrated in FIG. 10, the other test sample TS2 is placed on a back face of the test sample TS1, and is turned by 90 degrees relative to the test sample TS1. In this example, the test sample TS2 is turned to the left by 90 degrees relative to the test sample TS1. Here, both front sides OS of the test samples TS1 and TS2 are each directed upward.

Next, alignment is performed as illustrated in FIG. 11. Specifically, the center of the positioning reference mark PM2-1 in the test sample TS1 is aligned with the center of the positioning reference mark PM1-1 in the test sample TS2 visible through the inspection window IW (horizontal and vertical lines of the positioning reference mark PM2-1 are made to conform to those of the positioning reference mark PM1-1). Subsequently, the horizontal line of the positioning reference mark PM2-6 in the test sample TS1 is made to conform to the positioning reference mark PM2-1 in the test sample TS2. Then a deviation amount a of a line of the positioning reference mark PM1-1 in the test sample TS1 in the transportation direction and a line of the positioning reference mark PM1-6 in the transportation direction visible through the inspecting window IW is measured. This process corresponds to the "printing precision measuring step" in the present invention. The deviation amount a expresses orthogonal deviation of the printer 19 and the web paper WP.

With lower orthogonality as illustrated in FIG. 12, printing causes a shape of the test samples TS1 and TS2 not to be a rectangle but to be a parallelogram. In addition, since the test sample TS2 is turned by 90 degrees relative to the test sample TS1 such that both bottoms thereof conform to each other, a double deviation amount a is detected. Accordingly, only half the deviation amount a may be adjusted for controlling the orthogonality. In this way, detecting twice the orthogonal deviation amount allows accurate detection of the deviation amount.

<Step Measurement>

Figure 13:
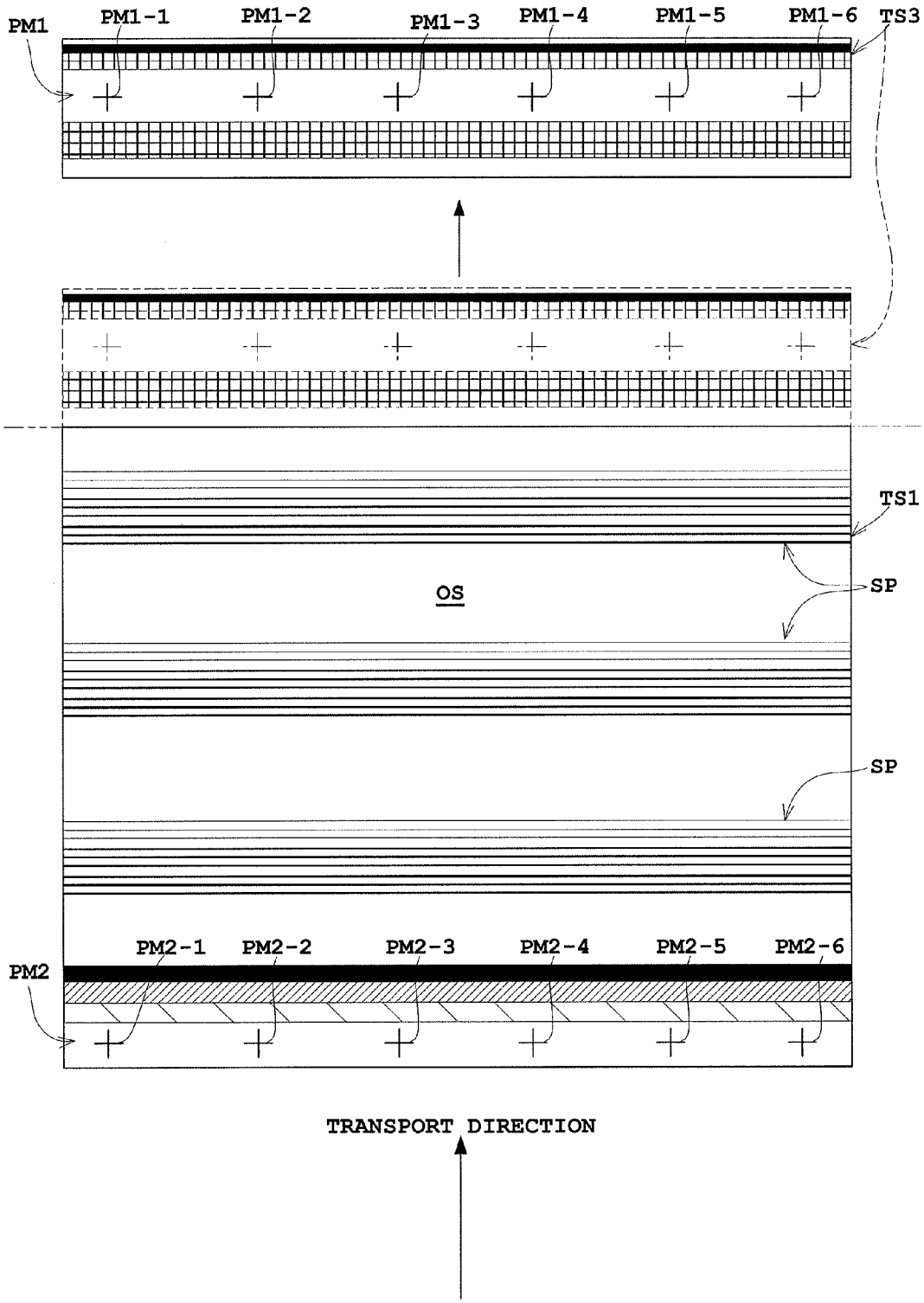
FIG. 13 is an explanatory view of the test sample used for measuring a step.
Figure 14A:
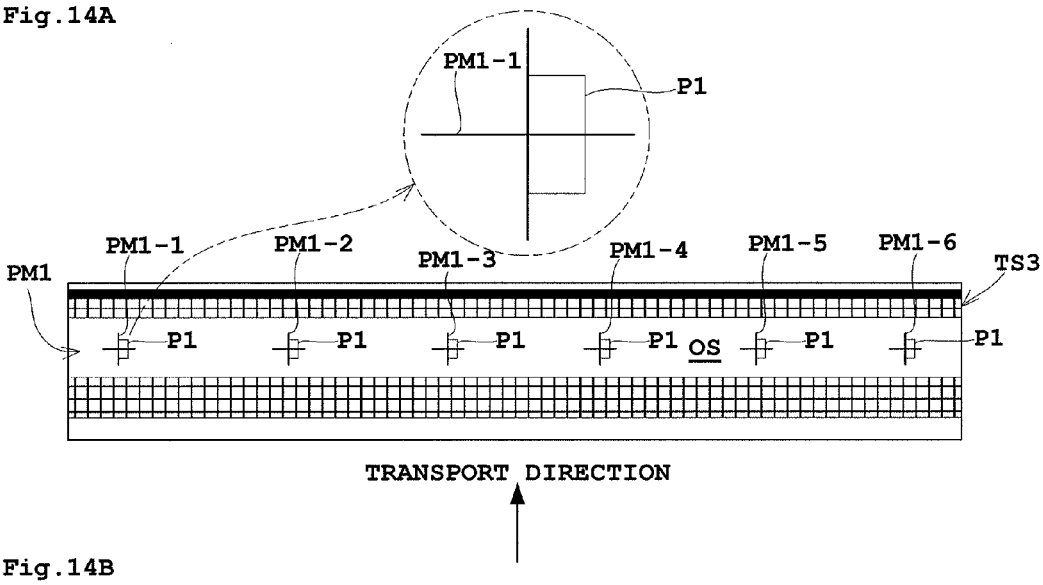
FIGS. 14A to 14C and 15 are schematic views each illustrating formation of the test sample.
Figure 14B:
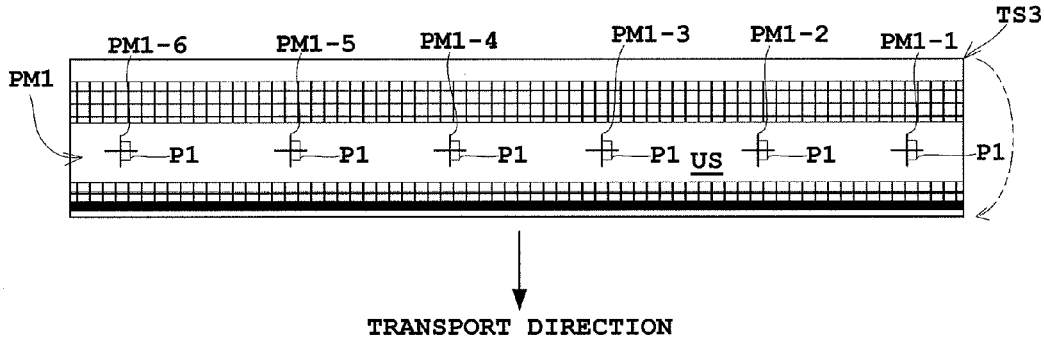
Figure 14C:
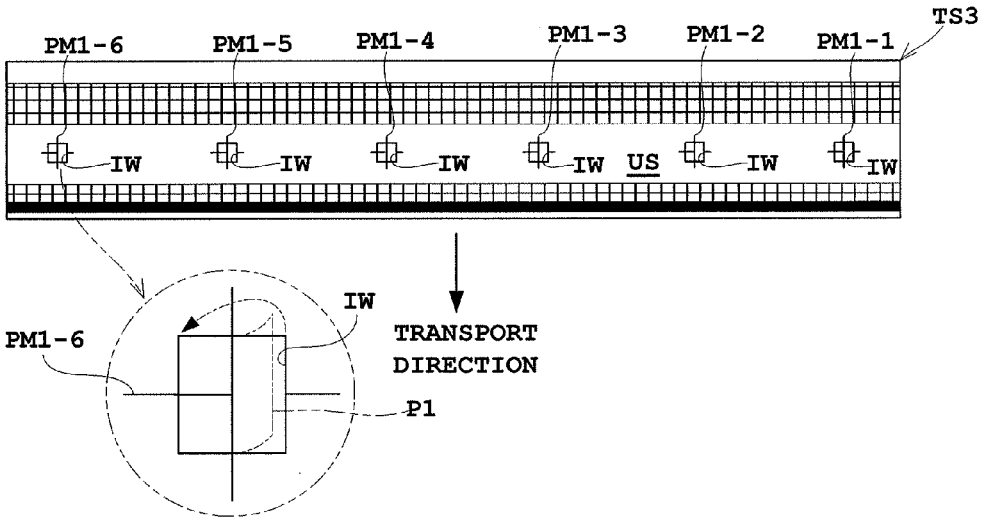
Figure 15:
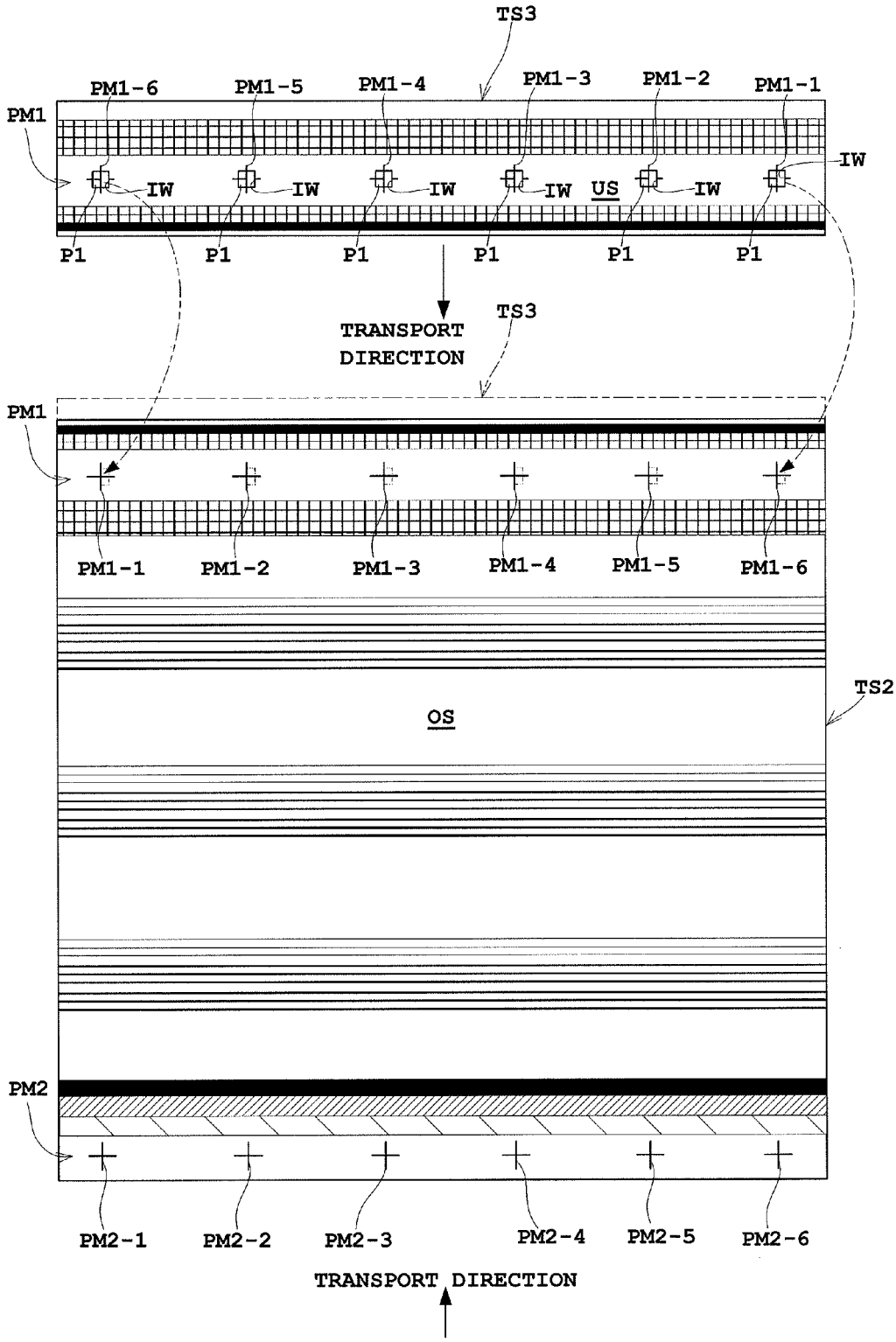

Now reference is made to FIGS. 13 to 16. FIG. 13 is an explanatory view of the test sample used for measuring a step. FIGS. 14A to 14C are schematic views illustrating formation of the test sample. FIG. 15 is a schematic view illustrating the formation of the test sample. FIG. 16A and FIG. 16B are explanatory views illustrating measurement of the step.

In order to measure a step, two test sample TS mentioned above are firstly generated. This process corresponds to the "printing step" in the present invention. As illustrated in FIGS. 13 and 14, these test samples TS1 and TS2 each have printed positioning reference marks PM1-1 to PM1-6 and PM2-1 to PM2-6 as well as linear test patterns SP.

Next, as illustrated in FIG. 13, the test sample TS1 is cut into a strip containing the positioning reference mark PM1 printed in advance, whereby a strip piece TS3 is formed.

As illustrated in FIG. 14A, a slit is formed in each of the positioning reference marks PM1-1 to PM16 in the strip piece TS3 foldable to one side from the line in the transportation direction, whereby a folding piece P1 is formed. In this example, the slit is rectangular. Alternatively, the slit may be semicircle. That is, the slit may have any shape as long as it is foldable.

Next, as illustrated in FIG. 14B, the strip piece TS3 is reversed in the transportation direction to make the rear side US directed upward. Then, as illustrated in FIG. 14C, the folding piece P1 is folded toward the surface of the strip piece TS3 (rear side US). Accordingly, an inspecting window IW is formed after the folding piece P1 is folded.

This process corresponds to the "inspecting-window forming step" in the present invention.

Then, as illustrated in FIG. 15, the strip piece TS3 overlaps the front side OS of the test sample TS2. Specifically, the strip piece TS3 overlaps to be aligned with a cut position of the test sample TS2 from which the strip piece TS3 is cut off. Consequently, the rear side US of the strip piece TS3 and the front side OS of the test sample TS2 are visible entirely in plan view. On the other hand, at a folding piece P1 of the strip piece TS3, only the front side OS of the strip piece TS3 is visible.

Accordingly, the positioning reference mark PM1 exposed at the folding piece P1 of the strip piece TS3 and the positioning reference mark PM1 of the test sample TS2 visible through the inspecting window IW are on the same front side OS.

Figure 16A:
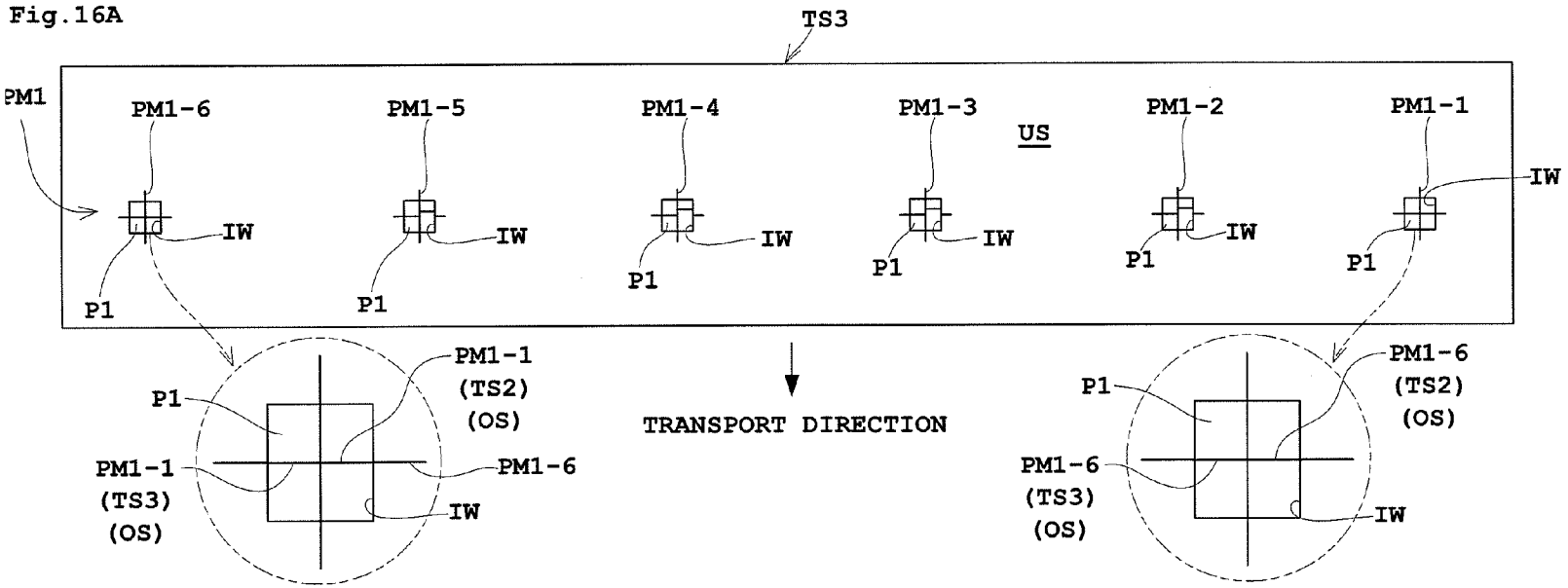
FIGS. 16A and 16B are each an explanatory view of measuring the step.

Next, as illustrated in FIG. 16A, both ends of the strip piece TS3 are aligned with both ends of the other test sample TS2. Specifically, the positioning reference mark PM1-6 in the strip piece TS3 is aligned with the positioning reference mark PM1-1 in the test sample TS2 visible through the inspecting window IW. Moreover, the positioning reference mark PM1-1 in the strip piece TS3 is aligned with the positioning reference mark PM1-6 in the test sample TS2 visible through the inspecting window IW. Here, the alignment is conforming the lines orthogonal to the transportation direction.

Figure 16B:
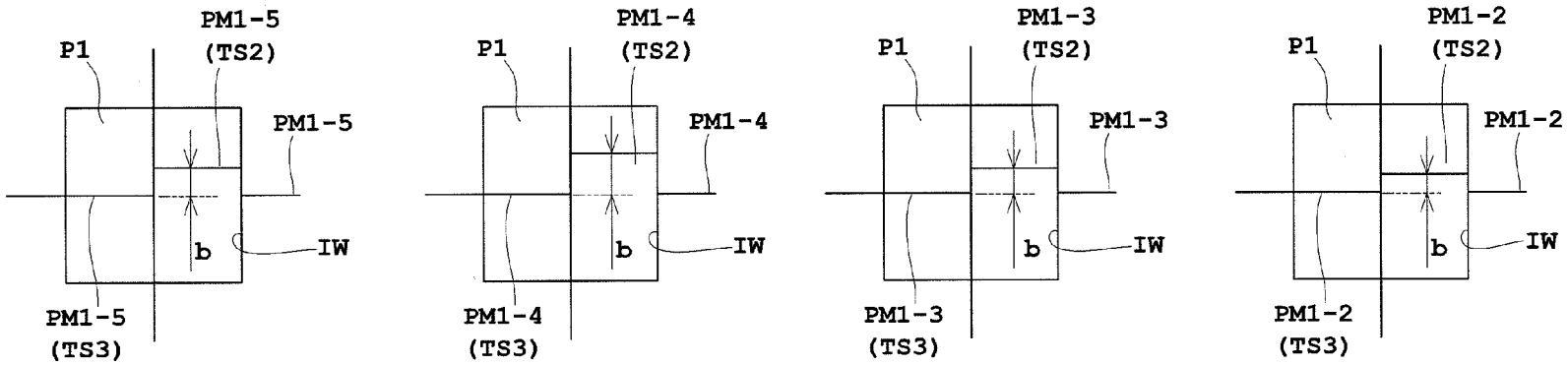

After the alignment, as illustrated in FIG. 16B, a deviation amount b is measured between the lines orthogonal to the transportation direction (horizontal line in FIG. 16B) of the positioning reference mark PM1 in the folding piece P1 (inspection window IW side) of the strip piece TS3 and the positioning reference mark PM1 visible through the inspecting window IW, except the positioning reference marks PM1 on both ends of the strip piece TS3. This process corresponds to the "printing precision measuring step" in the present invention.

Specifically, the followings are measured: a deviation amount b of a horizontal line to the transportation direction between the positioning reference mark PM1-5 (on the front side OS of the test sample TS2) in the folding piece P1 of the strip piece TS3 and the positioning reference mark PM1-5 (on the front side of the test sample TS2) visible through the inspecting window IW; a deviation amount b of the horizontal line to the transportation direction between the positioning reference mark PM1-4 (on the front side OS of the test sample TS3) in the folding piece P1 of the strip piece TS3 and the positioning reference mark PM1-4 (on the front side OS of the test sample TS2) visible through the inspecting window IW; a deviation amount b of the horizontal line to the transportation direction between the positioning reference mark PM1-3 (on the front side OS of the test sample TS3) in the folding piece P1 of the strip piece TS3 and the positioning reference mark PM1-3 (on the front side OS of the test sample TS2) visible through the inspecting window IW; and a deviation amount b of the horizontal line to the transportation direction between the positioning reference mark PM1-2 (on the front side OS of the test sample TS3) in the folding piece P1 of the strip piece TS3 and the positioning reference mark PM1-2 (on the front side OS of the test sample TS2) visible through the inspecting window IW.

Each of the deviation amounts b measured as above is detected having a double amount. This is because the test samples TS3 TS2 have transportation directions opposite to each other. Consequently, only needed is adjustment of the deviation amount of b/2 as half the deviation amount b when correction is made to each deviation (step) of the inkjet heads H1 to H6 in the printer 19 of the surface printing unit 5 from the line. In this way, the step with a double deviation amount is detected, causing accurate detection of the step.

Moreover, the strip piece TS3 having the front side OS directed upward is aligned with the test sample TS2 having the rear side US directed downward. This allows measurement of each deviation (step) of the inkjet heads H1 to H6 of the printer 31 in the rear face printing unit 9.

As mentioned above, the test sample TS according to the embodiment overlaps such that the positioning reference mark is visible through the inspecting window IW. This allows measuring printing precision by comparing the positioning reference mark PM on the side of the inspecting window IW and the positioning reference mark PM visible through the inspecting window IW. Here, a user merely bores the inspecting window IW. This is unaffected by measuring precision, and therefore no variation occurs to facilitate measurement. In addition, the positioning reference marks PM directly printed on the test sample TS are compared to each other. This enhances measuring precision. As a result, easy measurement of the printing precision can be achieved accurately with no additional element in the inkjet printing apparatus 1.

Moreover, in the inkjet printing apparatus 1 according to the embodiment, the printers 19 and 31 print a plurality of positioning reference marks PM. Then the test sample TS overlaps such that the positioning reference mark PM of the test sample TS is visible through the inspecting window IW. This allows measurement of the printing precision by comparing the positioning reference mark PM on the side of the inspecting window IW and the positioning reference mark PM visible through the inspecting window IW. As a result, easy measurement of the printing precision can be achieved accurately with no additional element in the inkjet printing apparatus 1.

With the printing precision measuring method according to the embodiment, the plurality of positioning reference marks PM is printed in the printing step. The inspecting window IW is formed in the positioning reference mark PM in the inspecting-window forming step, the positioning reference mark PM corresponding to the object to be inspected. In the printing precision determining step, the test sample TS is folded so as to make another positioning reference mark PM on the test sample TS visible through the inspecting window IW and the positioning reference mark PM on the side of the inspecting window IW is compared with the other positioning reference mark PM. This allows measuring printing precision. Here, a user merely bores the inspection window IW. This is unaffected by measuring precision, and therefore no variation occurs to facilitate measurement. In addition, the positioning reference marks PM printed on the test sample TS are compared to each other directly. This enhances measuring precision. As a result, easy measurement of the printing precision can be achieved accurately with no additional element in the apparatus.

This invention is not limited to the foregoing examples, but may be modified as follows.

(1) In the embodiment mentioned above, the web paper WP is described as one example of the printing medium. Alternatively, a printing medium other than the web paper is applicable to the present invention. Examples of the printing medium include a film and a paper sheet.

(2) The foregoing embodiment has been described taking for one example the inkjet-type printing apparatus 1 as the printing apparatus. The present invention is applicable to a printing apparatus of another type.

(3) The foregoing embodiment has been described taking for one example the positioning reference mark PM in a cross-shape. Alternatively, the present invention is applicable to the positioning reference mark in another shape as long as the positioning reference mark remains around the inspecting window IW.

This invention may be embodied in other specific forms without departing from the spirit or essential attributes thereof and, accordingly, reference should be made to the appended claims, rather than to the foregoing specification, as indicating the scope of the invention.

What is claimed is:

1. A printed matter for measuring printing precision of a printing apparatus configured to perform printing to both sides of a printing medium and having a plurality of recording heads arranged orthogonally to a transportation direction of the printing medium, the printed matter comprising:

a plurality of printed positioning reference marks corresponding respectively to each of the plurality of recording heads and printed orthogonally to the direction of transportation of the printing medium in the printing apparatus; and an inspecting window bored in a positioning reference mark of the plurality of positioning reference marks, the positioning reference mark corresponding to an object to be inspected, and being arranged in the printed matter so as to enable measuring printing precision by visually identifying another positioning reference mark to be compared with the positioning reference mark corresponding to the object to be inspected when the printing medium is folded, the object to be inspected including an end of the printing medium in the transportation direction of the printing medium.

2. A printing apparatus configured to perform printing to both sides of a printing medium, comprising:

a printing device having a plurality of recording heads arranged orthogonally to a transportation direction of the printing medium and configured to print a plurality of positioning reference marks orthogonally to the transportation direction of the printing medium, the plurality of positioning reference marks being arranged in the printing medium to enable respective inspecting windows bored in each of the positioning references to be used for measuring printing precision by visually identifying and comparing the positioning reference marks and an object to be inspected, the object to be inspected including an end of the printing medium in the transportation direction of the printing medium.

3. A printing precision measuring method for measuring printing precision of a printing apparatus configured to perform printing to both sides of a printing medium and having a plurality of recording heads arranged orthogonally to a transportation direction of the printing medium, the printing precision measuring method comprising:

a printing step of printing a plurality of positioning reference marks arranged orthogonally to a direction of transportation of the printing medium in the printing apparatus, corresponding respectively to each of the plurality of recording heads;

an inspecting window forming step of forming an inspecting window by boring a hole in a positioning reference mark of the plurality of positioning reference marks, the positioning reference mark corresponding to an object to be inspected, the object to be inspected including an end in the transportation direction of the printing medium; and a printing precision measuring step of measuring printing precision by folding the printing medium so as to make another positioning reference mark on the printing medium visible through the inspecting window and comparing the positioning reference mark on a side of the inspecting window with the positioning reference mark visible through the inspecting window.

4. The printing precision measuring method according to claim 3, wherein the plurality of positioning reference marks each have a cross shape formed by a line in the transportation direction of the printing medium and a line orthogonal to the transportation direction of the printing medium.

5. The printing precision measuring method according to claim 3, wherein the plurality of positioning reference marks is printed on a printing start position and a printing termination position of the printing medium.

6. The printing precision measuring method according to claim 3, wherein one test sample is generated in the printing step, the inspecting window is formed as a pair of inspecting windows forming step by boring the hole only in the center of a pair of positioning reference marks in the one test sample, the pair of positioning reference marks being on one side away from a bend line generated upon folding the test sample parallel to the transportation direction, and in the printing precision measuring step, the one test sample is folded along the bend line, and the pair of positioning reference marks on the side of the inspecting window is aligned with the pair of positioning reference marks on an opposite side across the bend line, a printing length on one side of the test sample is measured from a distance between the pair of positioning reference marks visible through the pair of inspecting windows, a printing length on the other side of the test sample is measured from a distance between the pair of positioning reference marks on the side of the inspecting window, and a deviation of printing start positions on the one side and the other side is measured from a deviation amount of the positioning reference marks on the side of the pair of inspecting window and the positioning reference marks visible through the pair of inspecting windows in a direction orthogonal to the transportation direction.

7. The printing precision measuring method according to claim 6, wherein the plurality of positioning reference marks each have a cross shape formed by a line in the transportation direction of the printing medium and a line orthogonal to the transportation direction of the printing medium.

8. The printing precision measuring method according to claim 6, wherein the plurality of positioning reference marks is printed on a printing start position and a printing termination position of the printing medium.

9. The printing precision measuring method according to claim 3, wherein a linear test pattern is printed orthogonal to the transportation direction in the printing step, and one end of the one test sample along the pair of inspecting windows is folded by a given width toward the pair of inspecting windows with the test sample being folded to confirm the linear test pattern at a folded portion of the test sample to the linear test pattern exposed due to folding the test sample.

10. The printing precision measuring method according to claim 9, wherein the plurality of positioning reference marks each have a cross shape formed by a line in the transportation direction of the printing medium and a line orthogonal to the transportation direction of the printing medium.

11. The printing precision measuring method according to claim 9, wherein the plurality of positioning reference marks is printed on a printing start position and a printing termination position of the printing medium.

12. The printing precision measuring method according to claim 3, wherein two test samples are generated in the printing step, in the inspecting window forming step, only the center of each of a first positioning reference mark, a second positioning reference mark, and a third positioning reference mark each seen like a hook in plan view is bored to form an inspecting window, the first and second positioning reference marks of one of the test sample being away from each other at two portions along the end in the transportation direction and the third positioning reference mark being away from the first positioning reference mark across the center in the transportation direction, and in the printing precision measuring step, one of the test samples is turned by 90 degrees relative to the other test sample to locate the other test sample on a back face of the one test sample, the first positioning reference mark conforms to the positioning reference mark of the other test sample through the inspecting window and the third positioning reference mark conforms to the positioning reference mark of the other test sample through the inspecting window, and thereafter, a deviation amount of the second positioning reference mark and the positioning reference mark of the other test sample through the inspecting window relative to a line connecting the first positioning reference mark with the second positioning reference mark is measured, whereby orthogonality in the transportation direction of the printing medium and the printing device configured to perform printing to the printing medium is measured.

13. The printing precision measuring method according to claim 12, wherein the plurality of positioning reference marks each have a cross shape formed by a line in the transportation direction of the printing medium and a line orthogonal to the transportation direction of the printing medium.

14. The printing precision measuring method according to claim 3, wherein two test samples are generated in the printing step, in the inspecting window forming step, one test sample is cut to form a strip piece containing the plurality of positioning reference marks printed on one side of the one test sample, a notch is formed in each of the plurality of positioning reference marks on one side, the notch being foldable relative to a line along the transportation direction, and the strip piece is reversed in the transportation direction such that the other side of the strip piece is directed upward, and each notch is folded to the other side, whereby the inspecting window is formed, and in the printing precision measuring step, the strip piece overlaps the plurality of positioning reference marks in the other test sample, and under a state where both ends of the plurality of positioning reference marks in the strip piece are aligned with both ends of the plurality of positioning reference marks in the other test sample by the line orthogonal to the transportation direction, a deviation amount of the positioning reference marks visible through the plurality of inspecting windows other than the both ends and orthogonal to the transportation direction and the positioning reference mark on the plurality of inspecting windows and folded orthogonal to the transportation direction is measured, whereby a step in the transportation direction of the plurality of printing heads orthogonal to the transportation direction is measured.

15. The printing precision measuring method according to claim 14, wherein the plurality of positioning reference marks each have a cross shape formed by a line in the transportation direction of the printing medium and a line orthogonal to the transportation direction of the printing medium.

* * * * *